US006338493B1

(12) United States Patent
Wohlgemuth et al.

(10) Patent No.: US 6,338,493 B1
(45) Date of Patent: Jan. 15, 2002

(54) WALKER CHAIR

(76) Inventors: Eli Wohlgemuth, 2282 Bedford Road, Montreal, Quebec (CA), H3S 1E9; Koen De Winter, 181 Place d'Youville, Montreal, Quebec (CA), H2Y 2B2

( * ) Notice: Subject to any disclaimer, the term of this patent is extended or adjusted under 35 U.S.C. 154(b) by 0 days.

(21) Appl. No.: 09/552,538

(22) Filed: Apr. 19, 2000

(51) Int. Cl.[7] ..... A61G 5/00

(52) U.S. Cl. ..... 280/30; 280/648; 280/250.1; 297/DIG. 4; 297/5; 135/66; 135/67

(58) Field of Search ..... 280/30, 87.021, 280/87.041, 87.05, 649, 650, 639, 42, 647, 648, 250.1, 87.01, 87.051, 47.4, 1.5, 200, 304.1; 135/65, 66, 67, 74, 75, 77; 297/5–7, DIG. 4, 485; 482/65–69

(56) References Cited

U.S. PATENT DOCUMENTS

| | | | | |
|---|---|---|---|---|
| 1,448,783 A | | 5/1923 | Blewitt et al. | |
| 2,866,495 A | | 12/1958 | Diehl et al. | |
| 3,354,893 A | | 11/1967 | Schmerl | |
| 3,584,890 A | * | 6/1971 | Presty | 280/7.1 |
| 4,748,994 A | | 6/1988 | Schultz et al. | |
| 4,759,562 A | | 7/1988 | Vinyard et al. | |
| 4,890,853 A | | 1/1990 | Olson | |
| D326,250 S | | 5/1992 | Oliver | |
| 5,320,122 A | | 6/1994 | Jacobson, II et al. | |
| 5,364,120 A | | 11/1994 | Shimansky | |
| 5,380,262 A | | 1/1995 | Austin | |
| 5,419,571 A | | 5/1995 | Vaughan | |
| 5,451,193 A | | 9/1995 | Pickard | |
| 5,558,358 A | | 9/1996 | Johnson | |
| 5,605,345 A | * | 2/1997 | Erfurth et al. | 280/250.1 |
| 5,636,651 A | * | 6/1997 | Einbinder | 135/67 |
| 5,647,602 A | * | 7/1997 | Nevin | 280/87.021 |
| 5,741,020 A | | 4/1998 | Harroun | |
| 5,794,639 A | * | 8/1998 | Einbinder | 135/67 |
| 5,813,948 A | | 9/1998 | Quigg et al. | |
| 5,819,772 A | | 10/1998 | Pi | |
| 5,882,067 A | | 3/1999 | Carbajal et al. | |
| 5,904,168 A | | 5/1999 | Alulyan | |

* cited by examiner

*Primary Examiner*—J. J. Swann
*Assistant Examiner*—J. Allen Shriver
(74) *Attorney, Agent, or Firm*—Rosenman & Colin LLP

(57) ABSTRACT

An apparatus that is convertible between walker and a wheelchair has one pair of wheels that are continually engaged with the ground and a second pair of wheels that are movable from a first position out of engagement or disengaged with the ground, in which the apparatus is used as a walker, to a second position into engagement with the ground, in which the apparatus is used as a wheelchair. The movable wheels are controllable by the operator through the use of handle members connected such wheels. The handle members rotate the wheels into and out of engagement with the ground along a path that is at an angle from the vertical, thereby assuring disengagement of the wheels from the ground.

29 Claims, 8 Drawing Sheets

WALKER CHAIR

FIELD OF THE INVENTION

This invention relates to walkers and wheelchairs in general, and more particularly, to an apparatus that is capable of being converted from a walker to a wheelchair.

BACKGROUND OF THE INVENTION

Supports for the handicapped and physically disabled are usually provided with varying levels of functionality. The conventional walker, for example, provides a user a with a stationary support and a means for maneuvering along a planar surface. If a walker is provided with wheels at one or both ends, then the level of mobility, along with the functionality of the apparatus, increases.

A further increase in functionality can be seen with the presence ancillary features that benefit the user during times of rest. For example, the walkers of U.S. Pat. Nos. 1,448,783 to Blewitt et al. and 3,354,893 to Schmerl are provided with a seat that pivots from a horizontal, use position within the center of the walker framework, to a vertical, non-use position, which is alongside the front of the walker and out of the way of the standing and moving operator. The seat not only contributes a highly desirable functional feature, but also adds a level of comfort and confidence in the operator should the operator need to rest suddenly or otherwise.

As the art evolved, other combination apparatus appeared wherein the conventional walker was combined with the comfort features of a wheelchair. As used herein, the term "wheelchair" is defined as a patient or user transport device, and not of the self-propelled variety. For example, U.S. Pat. Nos. 5,419,571 to Vaughan and 5,451,193 to Pickard both illustrate a four-wheeled wheelchair having an upwardly pivoting seat and arm rests that function as walker supports. When the seated operator of the wheelchair desires to walk, he or she merely lifts the seat and maneuvers the chair around using the wheelchair arm rests as handlebars. In both cases, the operator walks in the space where the seat used to exist.

Alternative designs for combination wheelchair/walkers exist. For example, in U.S. Pat. No. 5,558,358 to Johnson, a wheelchair seat is pivoted out of the way and the sides of the wheelchair are then partially collapsed to form a triangular wheel base configuration, with the operator using the wheelchair handlebars as a walker support. As another example, in U.S. Pat. No. 5,741,020 to Harroun, a walker support is provided as a forward extension of a wheelchair frame, allowing the seated individual to access the walker support by merely standing from the seat without re-orienting with respect to the seat.

The prior art is thus replete with combination apparatus that allow an operator to use the same device as both a walker and transport wheelchair, with varying levels of comfort and functionality. In all instances, however, the ground-engaging aspects of the apparatus, such as the wheels of a chair or the rubber feet of a conventional walker, remain unchanged during the conversion from walker to wheelchair and vice versa. In certain situations it would be desirable to have four wheels engaging the ground when being moved in a wheelchair, but only two wheels engaging the ground when operating a device as a walker. For example, if the operator used a combination device primarily as a support where it was necessary to be effectively "planted" in a particular location in between spurts of motion, the presence of four ground-engaging wheels might provide an unsatisfactory level of instability during resting conditions. In such a situation, for example, it would be desirable if at least one set of wheels could be converted into non-rotational feet that would effectively grip the ground during positions of rest, with the other set of wheels being used during periods of mobility.

The present inventor is not aware of any combination devices having convertible ground-engaging members featuring this level of functionality. There is a need, therefore, for a device that is convertible between a walker and wheelchair having convertible ground engaging members that provide varying levels of support and mobility. The apparatus of the present invention fulfills such need.

OBJECTS OF THE INVENTION

It is an object of the present invention, therefore, to provide a device that is convertible between a walker and wheelchair and provides varying levels of support and mobility for the operator.

It is another object of the present invention to provide a device that is convertible between a walker and a wheelchair and vice versa that is easy to use, operate, transport and store.

It is still another object of the present invention to provide a device that is convertible between a walker having two wheels and a wheelchair having four wheels.

It is still another object of the present invention to provide a convertible walker/wheelchair having two pairs of wheels, one pair being in continuous engagement with the ground and the other pair being in selective engagement with the ground.

Still other objects and advantages of the invention will become clear upon review of the following detailed description in conjunction with the appended drawings.

SUMMARY OF THE INVENTION

An apparatus that is convertible between walker and a chair has one pair of wheels that are continually engaged with the ground, floor or the like, and a second pair of wheels that are movable from a first position out of engagement or disengaged with the ground, in which the apparatus is used as a walker, to a second position into engagement with the ground, in which the apparatus is used as a non-self-propelled wheelchair. The movable wheels are controllable by the operator through the use of handle members connected such wheels. The handle members rotate the wheels into and out of engagement with the ground along a path that is at an angle from the vertical, thereby assuring disengagement of the wheels from the ground.

DETAILED DESCRIPTION OF THE PREFERRED EMBODIMENTS

Figure 1:
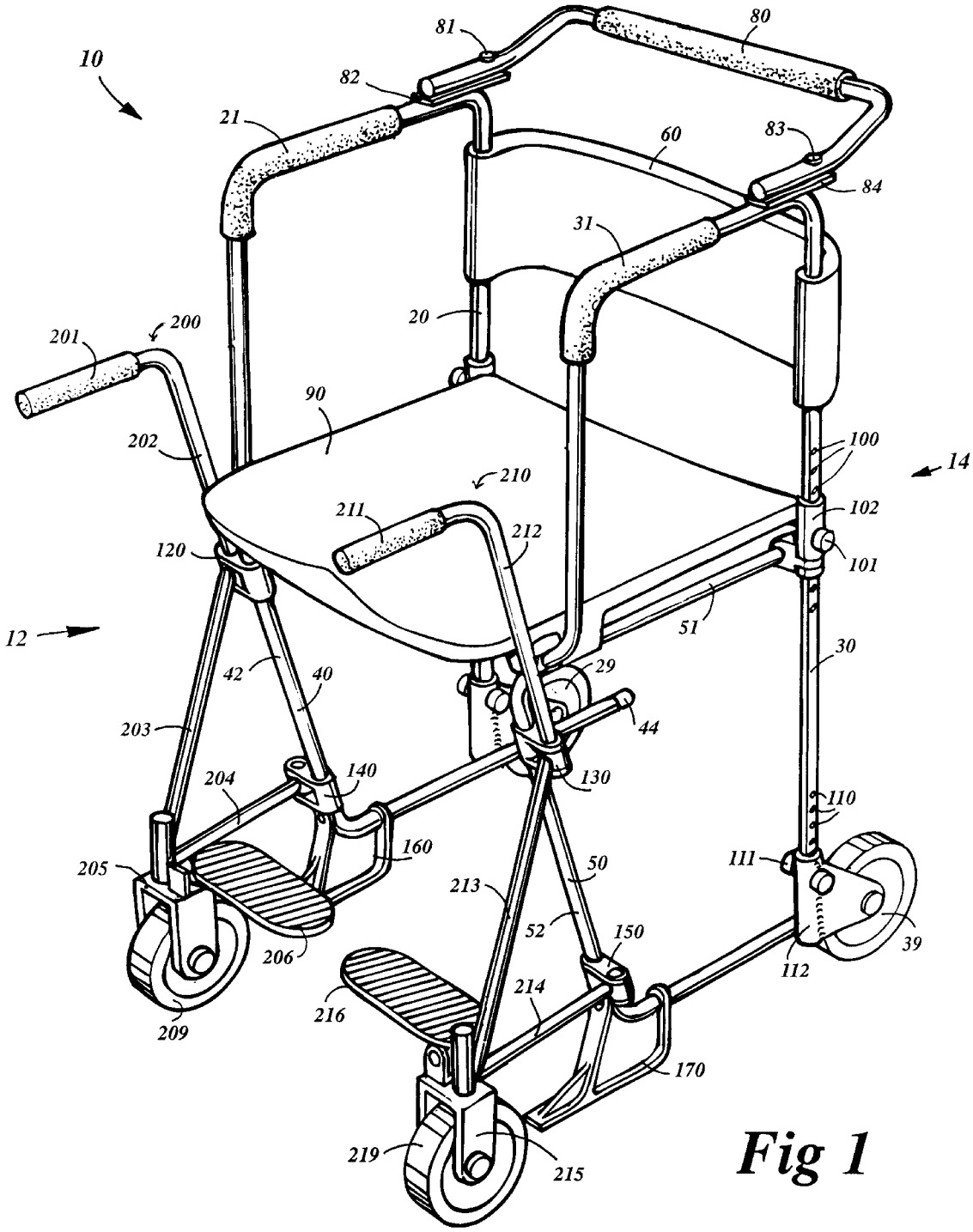
FIG. 1 illustrates the apparatus of the invention during use as a wheelchair.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

FIG. 1 is an isometric view of the apparatus of the invention 10 shown as a wheelchair, preferably of the patient transport type, having a first side 12, a second side 14, a pair of rear legs 20,30 and a pair of front legs 40,50. The term "wheelchair" as used herein preferably relates to a transport and not a self-propelled vehicle. A preferably molded backrest 60 extends between the first and second sides 12,14 and provides structural stability to the rear legs 20,30 and an outwardly extending handle 80 is provided above the backrest 60 for wheeling an individual seated on the seat 90. Gripping portions 21,31 are disposed at the upper ends and wheels 29,39 are disposed at the lower ends of the rear legs 20,30 respectively. In the embodiment shown in FIGS. 1–4 and 8, the rear legs 20,30 extend downward past the gripping portions 21,31 and are attached to the front legs 40,50 beneath the seat 90.

Figure 7:
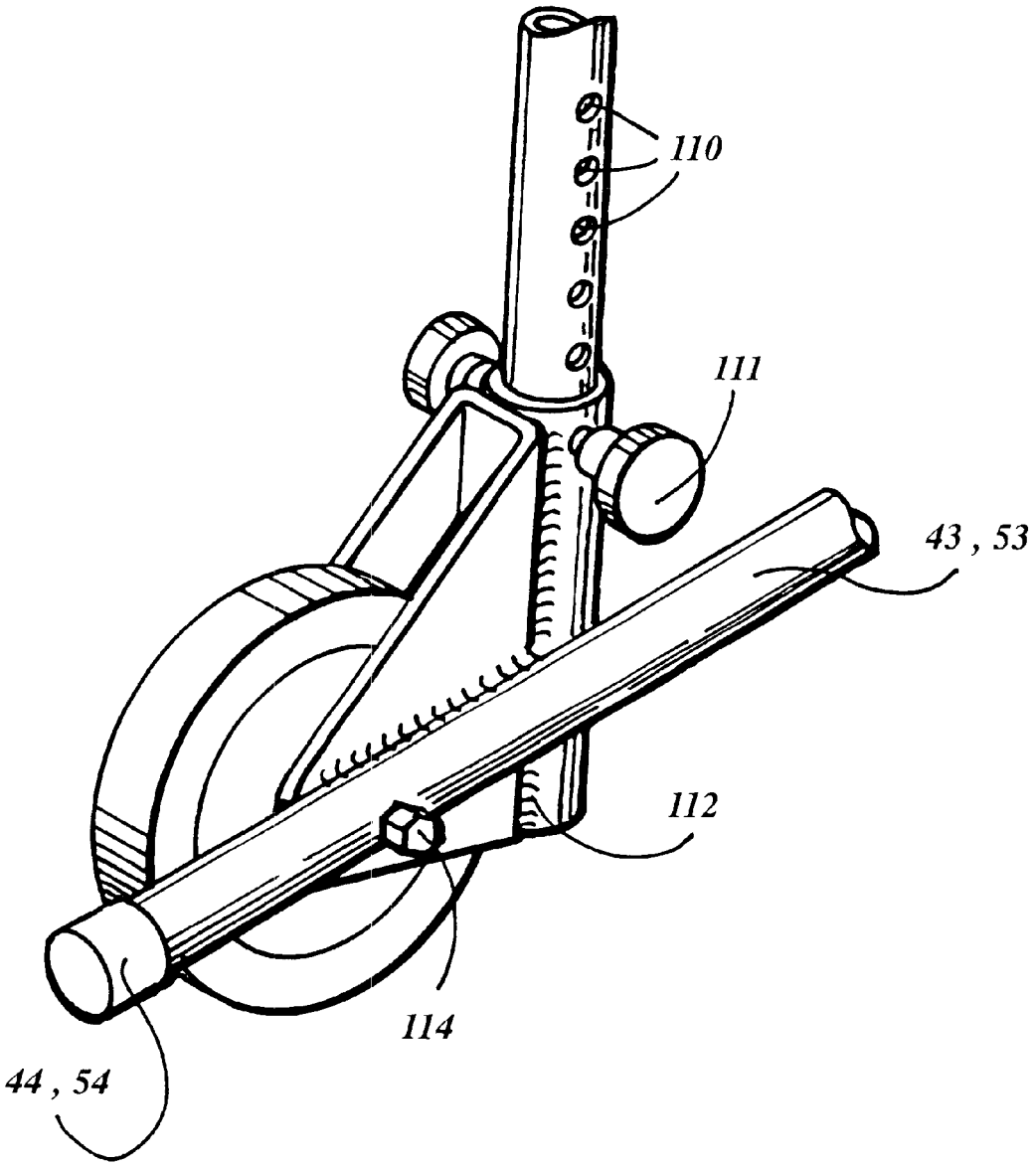
FIG. 7 is a close up view of a height-adjustable wheel disposed at the end of one of the legs of the apparatus of the invention.

Each rear leg 20,30 comprises a series of spaced-apart holes 100,110 through which a pin or bolt 101,111 housed within a sleeve 102 or socket 112 is slidable (see also FIG. 7). The pin or bolt 101,111 can be a one-piece (101) or a two-piece (111) member, and can be spring-biased as desired. Other equivalent methods of height-adjustment other than that shown in the accompanying figures may be used.

The front legs 40,50 of the apparatus 10 span a preferably "U"-shaped path, beginning at the first sleeve 102 and extending initially along a substantially horizontal path serving as the structural support 41,51 (see FIG. 2) for the gripping portions 91,92 of the seat 90. The front legs 40,50 continue through a sleeve 120,130 and assume a downward orientation along a leg section 42,52 at an angle $\phi$ (see FIG. 8) from the vertical. Such legs 40,50 continue through another sleeve 140,150 and re-assume a horizontal orientation along a lower leg section 43,53, finally terminating at a covered end section 44,54 extending beyond the rear wheels 29,39. Thus, in the disclosed embodiments, two height-adjustment sections are needed because each sleeve 102 or socket 112 is connected to each other by the front legs 40,50, which extend in a "U" shaped path from the first height-adjustment sleeve in the middle of the rear legs 20,30 to the second height-adjustment sleeve adjacent the rear wheels 29,39. As shown in FIG. 7, the lower sections 43,53 of the front legs 40,50 are connected to the rear wheels 29,39 by bolts 114, which bolts 114 also serve as axles for the wheels 29,39. As will be described later in more detail, non-rotating feet members 160,170, which are attached to the front legs 40,50 below the sleeve members 140,150, engage the ground when the apparatus 10 is used as a walker (see FIG. 2), but do not engage the ground when the apparatus is used as a wheelchair (see FIG. 1). Such feet members 160,170 could be sled-like as shown, skis or rubber stopper members as is known in the art, or the like. Also, the end sections 44,54 may be used as leverage devices by a transporter individual of a wheelchair occupant if it is desired to overcome obstacles or the like in the path of the wheelchair. A transporter may, for example, step on the end sections 44,54 while simultaneously pulling downward upon the handlebar 80 to lift the front wheels 209,219 an appropriate distance to overcome or maneuver around an obstacle in the path of the wheelchair.

Figure 2:
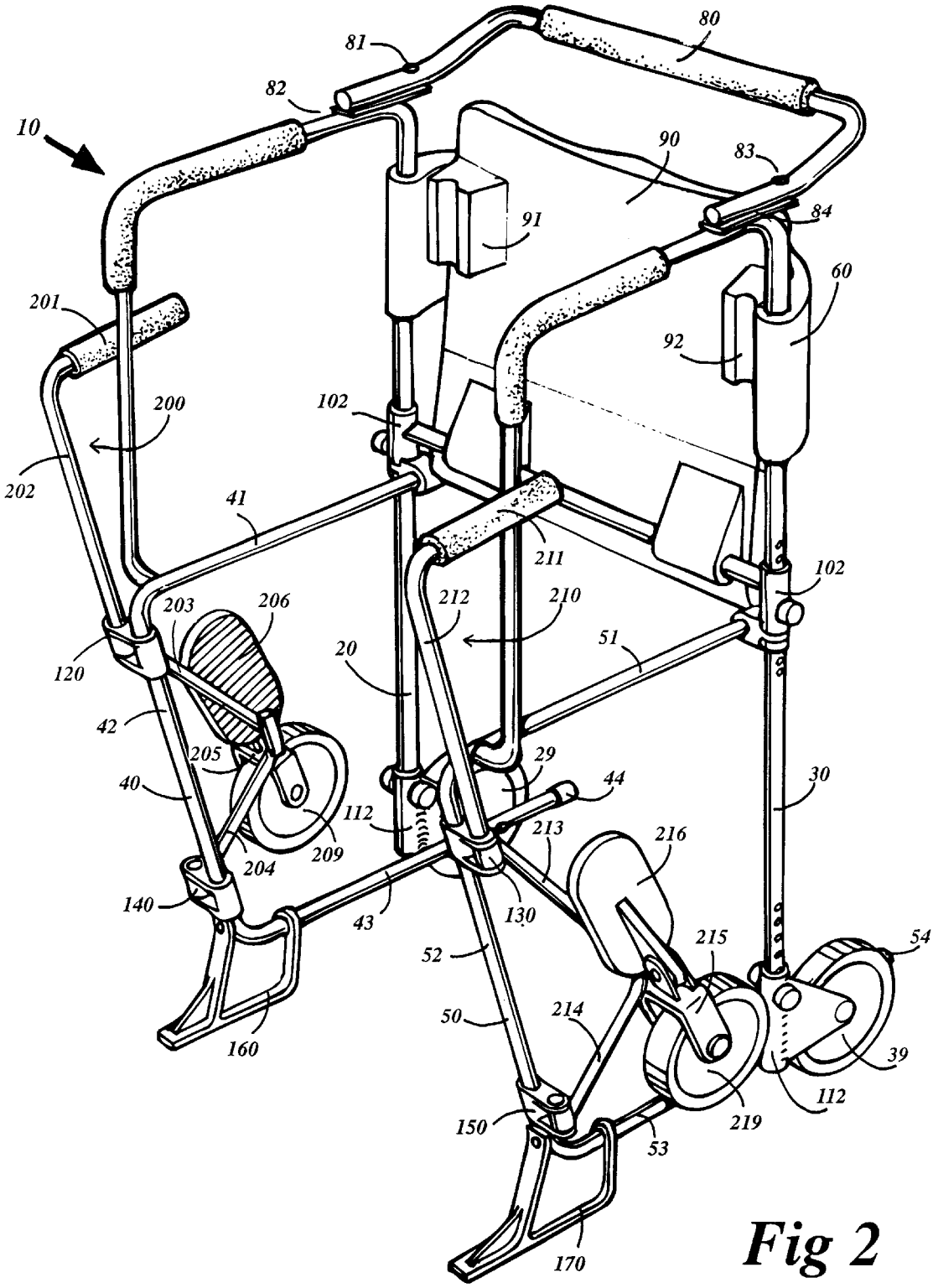
FIG. 2 illustrates the apparatus of the invention during use as a walker.

A pair of handle members 200,210 are rotatably coupled to the front legs 40,50 through the sleeve members 120,130 and comprise a pair of hand grips 201,211 at the ends of upper portions 202,212, a pair of lower portions 203,213 preferably arranged at a different angular orientation with respect to the upper portions 202,212 and connected to a pair of front wheels 209,219, or more particularly to a pair of wheel supports 205,215, a pair of crossbars 204,214 connected between the wheel supports 205,215 and the sleeves 140,150 and a pair of footrests 206,216 that are pivotably connected to the wheel supports 205,215. The footrests 206,216 provide support for a user's feet (see FIG. 8) while such user is seated, and pivot upwardly and out of the way while the apparatus 10 is being used as a walker (FIG. 2). As will be described later in more detail, the handle members 200,210 serve as a converting mechanism for used to rotate the front wheels 209,219 from a position in engagement with the ground (see FIG. 1), during which the apparatus 10 is used as a wheelchair, to a position out of engagement with the ground (see FIG. 2), during which the apparatus 10 is used as a walker, and vice versa. The handle members 200,210 also serve as handle grips for helping a person get up from the seated position when using the apparatus as a wheelchair.

Figure 5:
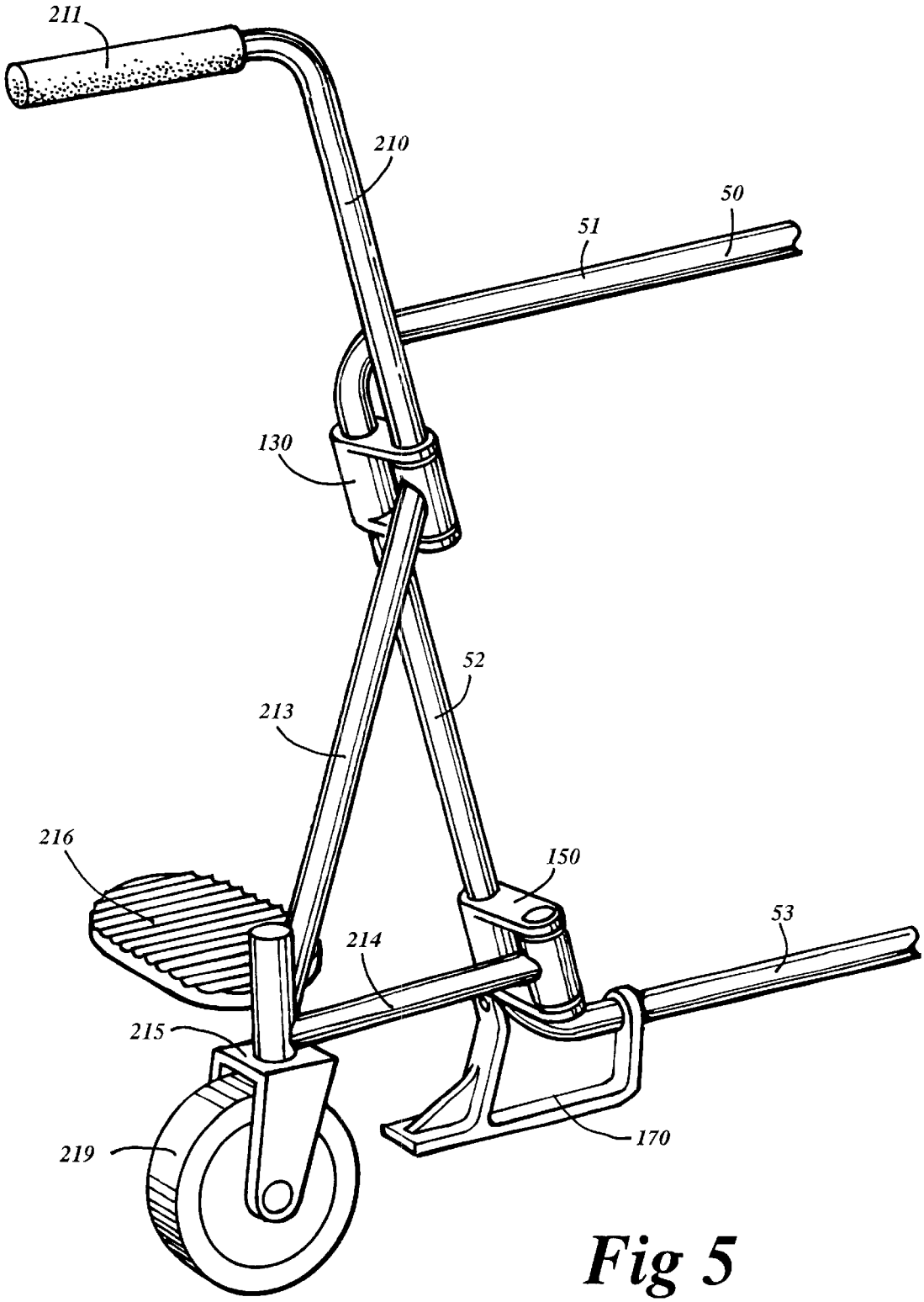
FIG. 5 is a close up view of a wheel that is rotatably coupled to a leg of the apparatus, shown engaged with the ground during use of the apparatus as a wheelchair.
Figure 6:
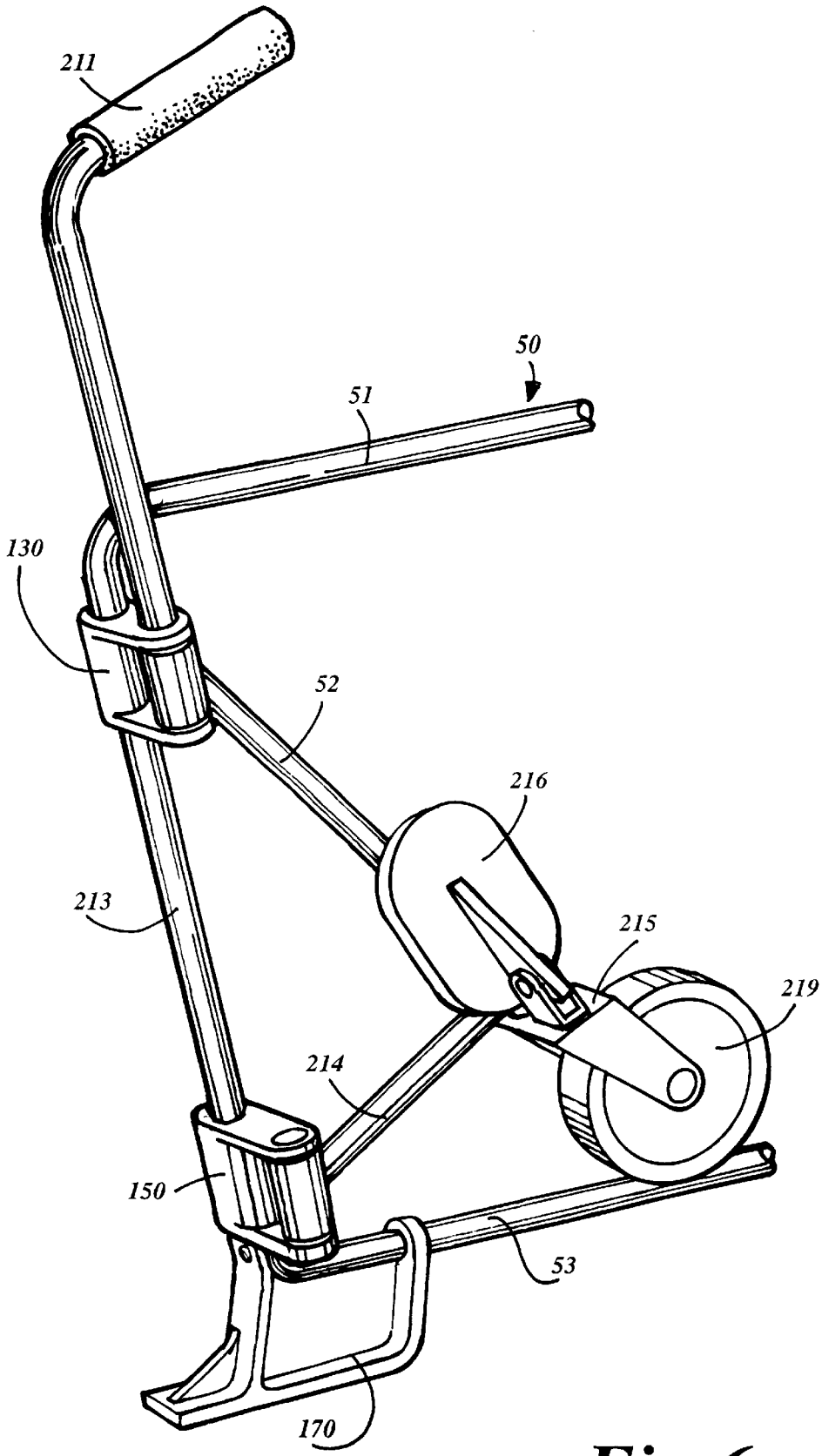
FIG. 6 is a close up view of a leg having a sliding foot disposed at the end thereof and a wheel coupled to said leg that has been rotated out of engagement with the ground.
Figure 8:
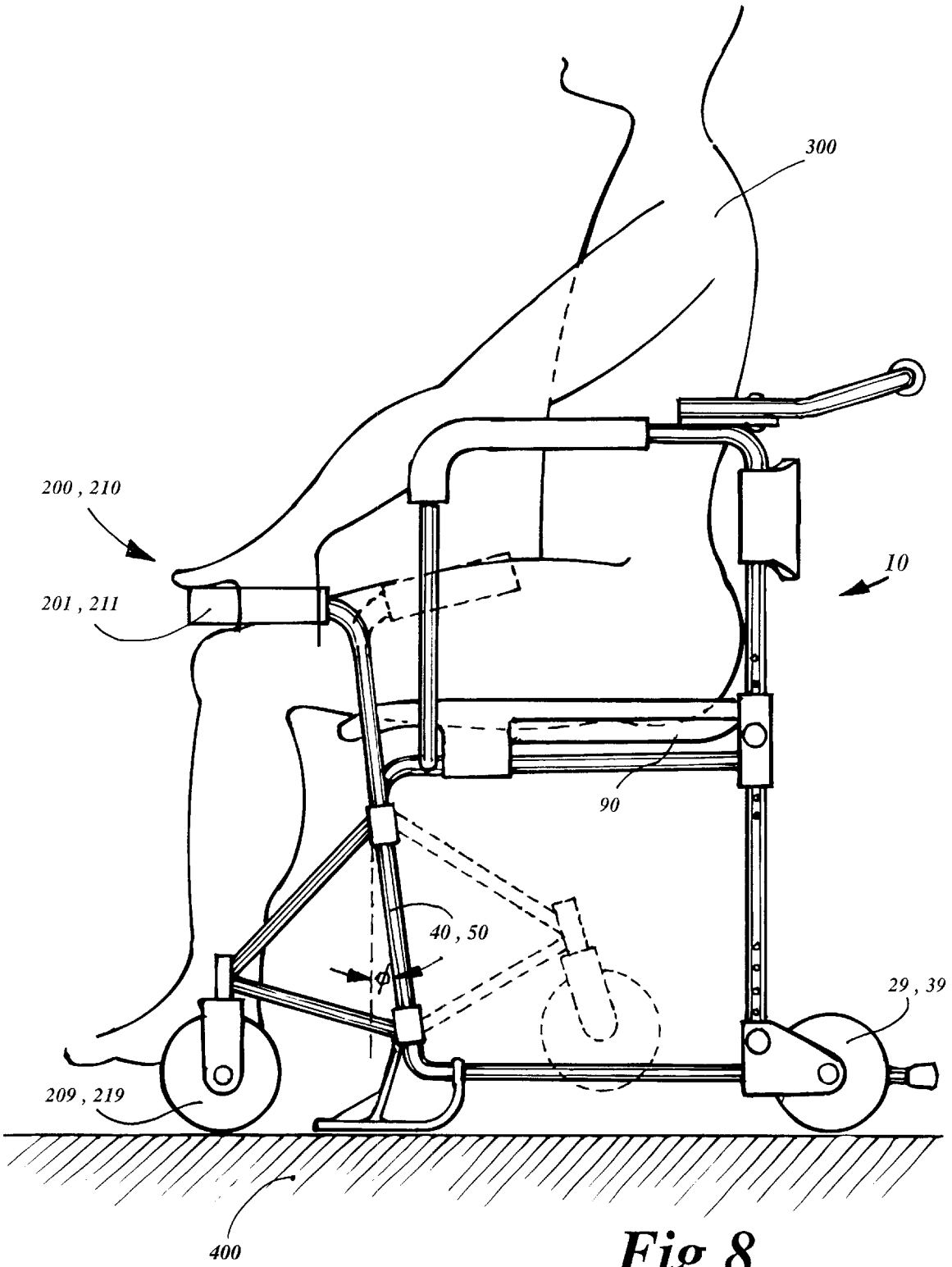
FIG. 8 illustrates an occupant of the apparatus of the invention seated in the wheelchair with the handles rotated to show the conversion from a wheelchair into a walker.

As shown in FIG. 8, conversion from a wheelchair (FIG. 1) to a walker (FIG. 2), and vice versa, occurs as follows. While a user occupant 300 is seated on the seat 90, the user lifts the foot pedals 206,216 with his/her feet, raises himself/herself from the seat 90, grips the hand grips 201,211 and rotates the handle members 200,210 around the front legs 40,50 from a position where the front wheels 209,219 engage the ground 400 (shown in solid in FIG. 8, see also FIGS. 1 and 5) to a position where the front wheels 209,219 are disengaged from the ground 400 (shown in phantom in FIG. 8) and the feet 160,170 are engaged with the ground 400 (see FIGS. 2 and 6). In the disclosed embodiments, the operator may have to lift slightly from the seat during this conversion, although depending on the construction of the apparatus such lifting may not be necessary. The handle member 200 is rotated in a clockwise direction while the handle member 210 (see FIGS. 5 and 6) is rotated in a counter-clockwise direction with respect to the user 300. The handle members 200,210 might be provided with motion-limiting means (not shown), such as cam surfaces, that restrict the rotation of the handle members 200,210, and therefore the front wheels 209,219, to an approximate 180-degree arc. Since the front legs 40,50 are positioned an angle $\phi$ (see FIG. 8) from the vertical, and since the front wheels 209,219 are coupled to the front legs 40,50 via handle members 200,210 and rotatable thereabout as shown, the rotation of the handle members 200,210 causes the wheels 209,219 to both rotate about the legs 40,50 and at the same time lift from or become disengaged from the ground.

During the conversion and during use of the apparatus as both a walker (FIG. 2) and a wheelchair (FIG. 1), the rear wheels 29,39 remain in continuous engagement with the ground 400. Once the front wheels 209,219 have been moved out of engagement with the ground 400, the user pivots the seat 90 upward toward the backrest 60, where it is frictionally held by the mating contours of the seat 90 and the backrest 60. The user then faces the backrest 60, grips the handle portions 21,31 and uses the apparatus 10 as a walker (see FIG. 2). These steps may be reversed to convert the apparatus of the invention 10 from a walker (FIG. 2) to a wheelchair (FIG. 1).

FIG. 2 illustrates the apparatus of the invention 10 in the walker configuration. It will be appreciated that if the user 300 (see FIG. 8) is comfortable walking, is not overly imbalanced and does not therefore need the apparatus of the invention 10 to primarily support his/her body weight, the user 300 will be able to propel the apparatus 10 along with the help of the ground-engaged rear wheels 29,39 and the feet 160,170 will merely slide across the ground, floor or whatever surface the user 300 and the apparatus 10 are positioned on. In fact, if desired, the user may merely rotate the feet pedals 206,216 out of the way and lift the seat 90 to a position as shown in FIG. 2 and keep the front wheels 209,219 in engagement with the ground (i.e., not rotate them out of engagement with the ground to a position as shown in FIG. 2) and thereby use the apparatus of the invention as a four-wheeled walker, gripping the handles 21,31 for minimal support.

If, however, the user is somewhat imbalanced, the apparatus 10 of the invention, with the front wheels 209,219 rotated out of engagement with the ground, will be able to sustain the user's weight through the non-rotational engagement of the sled-like feet 160,170 with the ground without worrying about the apparatus 10 rolling into an undesirable position or location. In other words, with a two-wheeled walker embodiment of FIG. 2, half of the legs 40,50 can be firmly planted on the ground to prevent the apparatus 10 from escaping or rolling away from the user. This situation, i.e., two-wheeled walker configuration, will be clearly desirable for most applications where the user primarily relies on the support provided by the walker to both stand and maneuver around a given area.

Figure 3:
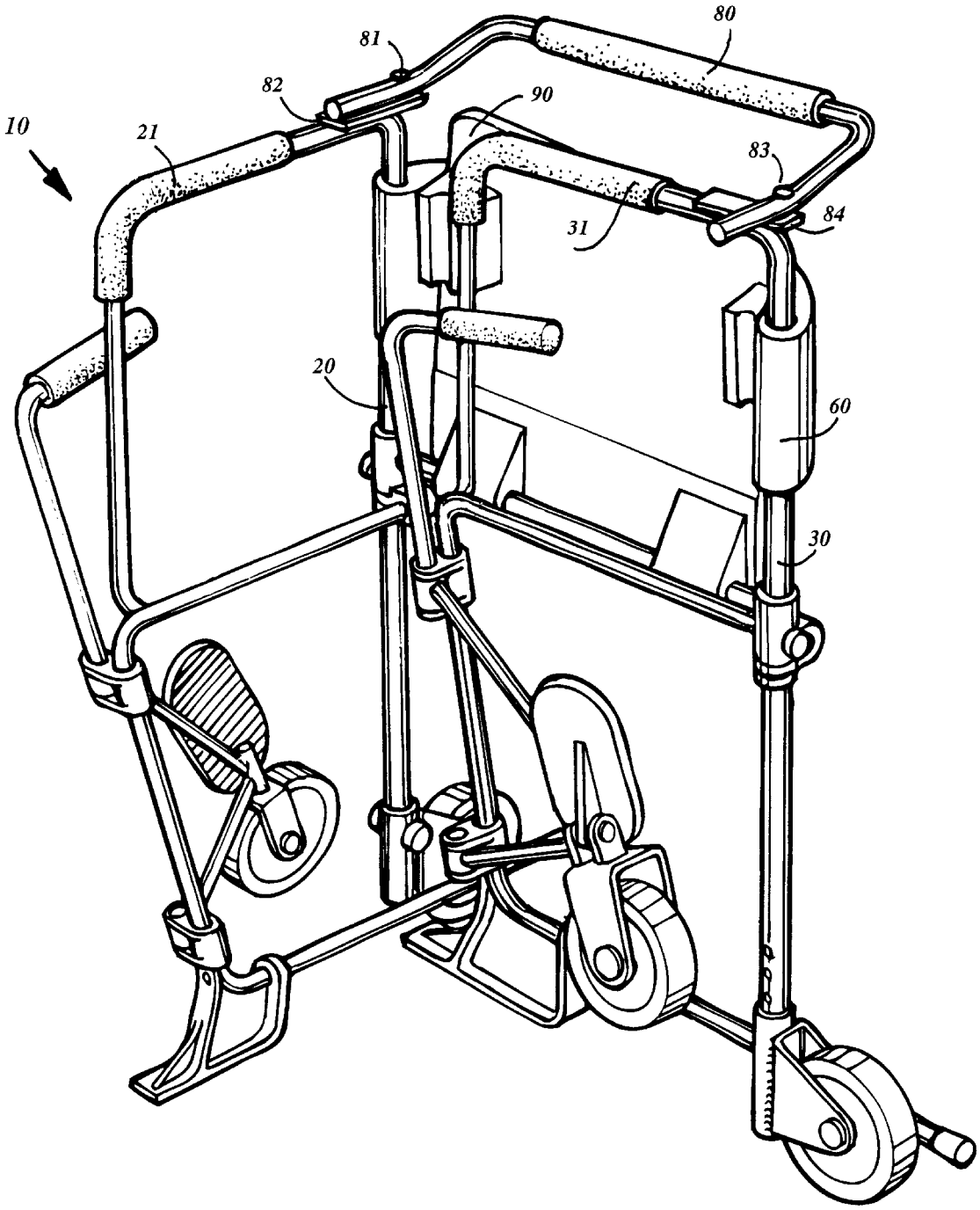
FIG. 3 shows one side of the apparatus of the invention collapsed inward in preparation for storage
Figure 4:
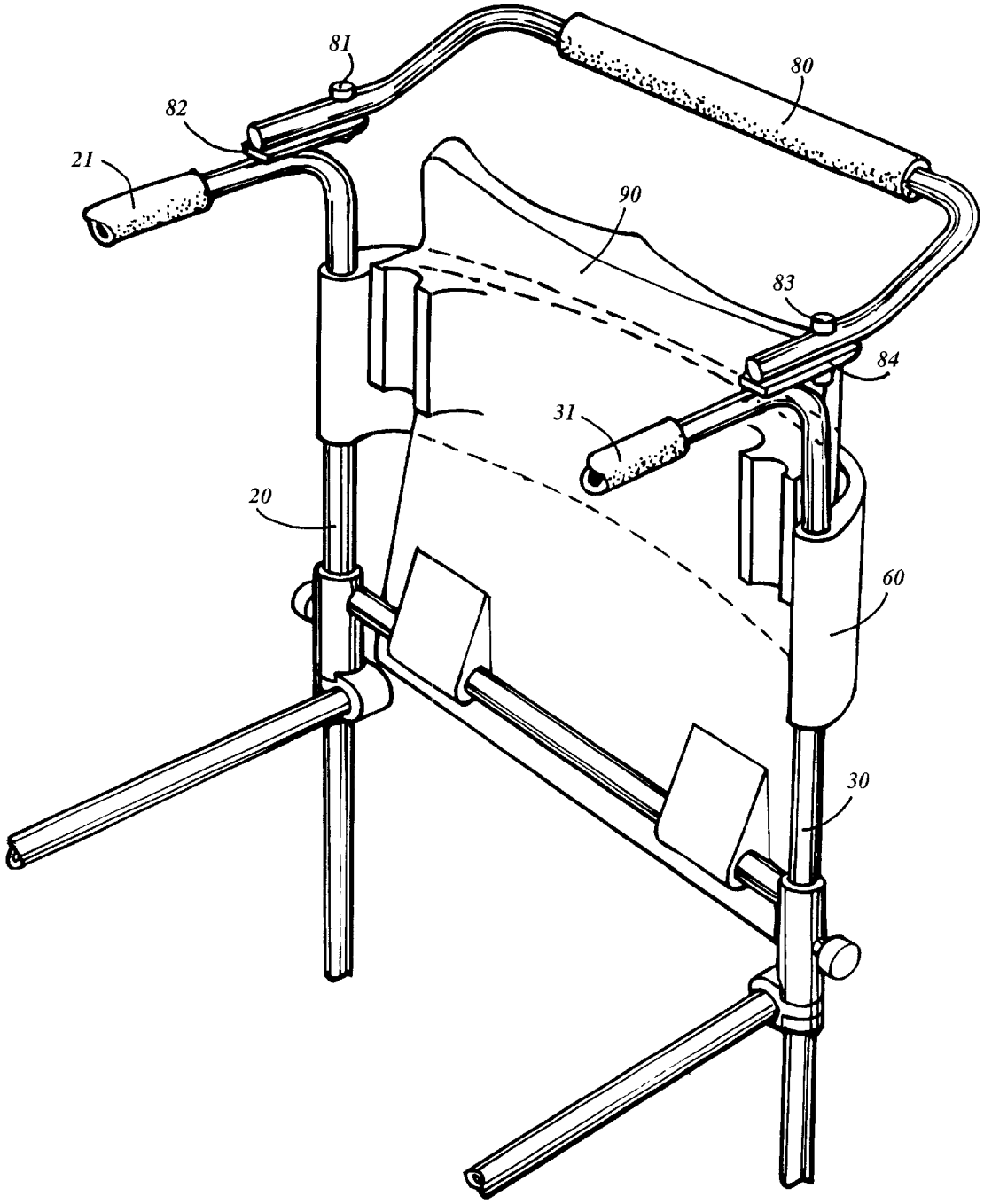
FIG. 4 is a close up view of the seat folded upward during use of the apparatus of the invention as a walker.

As shown in FIGS. 3 and 4, the apparatus of the invention 10 is collapsible for easy transport and storage. The handle member 80 is connected to the sides 12,14 of the apparatus 10, and more particularly to the rear legs 20,30, by a pair of bolts or the like 81,83 fastened through connector plates 82,84 at one end, which connector plates 82,84 are fastened by welding or the like at their other ends to the rear legs 20,30. Each side 12,14 of the apparatus 10 is collapsible inward toward the back rest 60 and the upwardly pivoted seat 90 by inward rotation of the rear legs 20,30 as shown, moving from a position that substantially perpendicular to the backrest 60 to a position that is substantially parallel to the backrest 60. The rear legs 20,30 rotate around the bolts 81,83 through the connector plates 82,84, which prevents the need for the handle 80 to undergo a telescopic change of length during the folding and unfolding of the apparatus 10.

It should be appreciated that the apparatus of the present invention provides a level of functionality that is far superior to the convertible walkers/wheelchairs of the prior art. Having at least one pair of wheels in selective engagement with the ground provides the user with the ability to vary the level and type of support during use in the walker configuration.

While the present invention has been described at some length and with some particularity with respect to the preferred embodiments, it is not intended that it should be limited to such particulars embodiments or any particular embodiment, but it is to be construed with references to the appended claims so as to provide the broadest possible interpretation of such claims in view of the prior art and, therefore, to effectively encompass the intended scope of the invention. For example, while the front wheels are each separately rotatable around their respective legs, it will be appreciated that the front wheels could be connected via a suitable linkage such that a movement of one wheel will automatically cause the movement of the other wheel. In addition, while it is preferred to have only one pair of wheels be selectively engageable with the ground for the reasons mentioned above, other scenarios will be operable, such as if both pairs of wheels were collectively or separately engageable with the ground through the use of varying lever members or the like. Thus, the apparatus of the invention could, for example, be converted from a wheelchair having four wheels that engage the ground to a walker having no wheels that engage the ground and vice versa. Other features could also be implemented into the apparatus of the invention, such as hand brakes or foot brakes for the wheels, and the like.

What is claimed is:

1. An apparatus convertible between a walker and a wheelchair for use on the ground comprising:

a) a frame having a first side, a second side and a backrest extending therebetween, each side having a front leg and a rear leg, b) said front legs having a pair of front wheels respectively associated therewith and said rear legs having a pair of rear wheels respectively associated therewith, c) a seat pivotally connected to said frame and movable between a first position during which the apparatus is used as a wheelchair to a second position during which the apparatus is used as a walker, and d) a converting mechanism associated with one of said pair of wheels, wherein said one of said pair of wheels is movable with the use of said converting mechanism between a first position, where said wheels engage the ground in which the apparatus is used as a wheelchair, to a second position where said wheels are disengaged from the ground in which the apparatus is used as a walker, e) wherein said converting mechanism further comprises means for respectively rotating said one of said pair of movable wheels about their respective legs between said first and second positions.

2. An apparatus in accordance with claim 1, wherein said converting mechanism further comprises a pair of handle members for respectively moving said each of said pair of wheels about their respective legs between said first and second positions.

3. An apparatus in accordance with claim 1, wherein said converting mechanism further comprises a pair of handle members for respectively rotating said each of said pair of movable wheels about their respective legs between said first and second positions.

4. An apparatus in accordance with claim 1, wherein the other of said pair of wheels is adapted for continuous engagement with the ground.

5. An apparatus in accordance with claim 1, wherein said legs associated with said movable wheels further comprise non-rotating feet adapted to engage the ground when the movable wheels are disengaged from the ground.

6. An apparatus in accordance with claim 5, further comprising handle members coupled to said legs associated with said movable wheels.

7. An apparatus in accordance with claim 6, further comprising sleeve members for coupling said handle members with said legs associated with said movable wheels.

8. An apparatus in accordance with claim 1, wherein said legs associated with said movable wheels are oriented at an angle from the vertical.

9. An apparatus in accordance with claim 1, wherein said second position of said movable wheels is located nearer to said backrest than said first position of said movable wheels.

10. An apparatus in accordance with claim 1, wherein said apparatus is collapsible.

11. An apparatus in accordance with claim 10, wherein said first and second sides are movable from a first position substantially perpendicular to said backrest to a second position substantially parallel to said backrest.

12. An apparatus in accordance with claim 1, wherein said frame further comprises a handlebar positioned above said backrest and extending away from said seat.

13. An apparatus convertible between a walker and a wheelchair for use on the ground comprising:

a) frame having a first side, a second side and a backrest extending therebetween, each side having a front leg and a rear leg, b) said front legs having a pair of front wheels respectively associated therewith and said rear legs having a pair of rear wheels respectively associated therewith, and c) a seat pivotally connected to said frame, d) wherein one of said pair of wheels is adapted for continuous engagement with the ground and the other of said pair of wheels is adapted for selective engagement with the ground, e) wherein said pair of wheels adapted for selective engagement with the ground is rotatable around its respective legs between a first position, where said wheels are disengaged from the ground and said apparatus is used as a walker, to a second position where said wheels engage the ground and said apparatus is used as a wheelchair.

14. An apparatus in accordance with claim 13, wherein said pair of wheels that are adapted for selective engagement with the ground are rotatably coupled to said legs associated with said wheels.

15. An apparatus in accordance with claim 14, wherein said pair of wheels that are adapted for continuous engagement with the ground are disposed at the ends of said legs associated with said wheels.

16. An apparatus in accordance with claim 14, further comprising sleeve members for coupling said pair of wheels that are adapted for selective engagement with the ground with said legs associated therewith.

17. An apparatus in accordance with claim 13, further comprising a converting mechanism for moving said pair of wheels adapted for selective engagement with the ground between a first position, where said wheels are disengaged from the ground and said apparatus is used as a walker, to a second position where said wheels engage the ground and said apparatus is used as a wheelchair.

18. An apparatus in accordance with claim 16, further comprising handle members coupled to said legs associated with said pair of wheels adapted for selective engagement with the ground for moving said pair of wheels into and out of engagement with the ground.

19. An apparatus in accordance with claim 18, wherein said handle members further comprise an upper portion having a handgrip and a lower portion connected to said wheels.

20. An apparatus in accordance with claim 19, wherein said upper portion and said lower portion of said handle members are arranged at different angular orientations.

21. An apparatus in accordance with claim 13, wherein said legs associated with said wheels that are adapted for selective engagement with the ground are oriented at an angle from the vertical.

22. An apparatus convertible between a walker and a wheelchair for use on the ground comprising:

a) a frame having a seat, a first side, a second side and a backrest extending between said first and second sides, each side having a front leg and a rear leg, b) said front legs and rear legs respectively having a pair of front wheels and a pair of rear wheels associated therewith, c) wherein said pair of rear wheels is adapted for continuous engagement with the ground and said pair of front wheels is adapted for selective engagement with the ground, d) wherein said pair of front wheels are rotatable between a first position, where said wheels are not in contact with the ground and said apparatus is used as a walker, to a second position where said wheels contact the ground and said apparatus is used as a wheelchair.

23. An apparatus in accordance with claim 22, wherein said front wheels are attached to and controllable by handle members.

24. An apparatus in accordance with claim 23, wherein said handle members are coupled to said front legs and not integral therewith.

25. An apparatus in accordance with claim 22, wherein said apparatus is collapsible.

26. An apparatus in accordance with claim 25, wherein said first and second sides are movable from a first position substantially perpendicular to said backrest to a second position substantially parallel to said backrest.

27. An apparatus in accordance with claim 22, wherein said front legs are oriented at an angle from the vertical.

28. An apparatus convertible between a walker and a wheelchair for use on the ground comprising:

a) a frame having a first side, a second side and a backrest extending therebetween, each side having a front leg and a rear leg, b) said front legs having a pair of front wheels respectively associated therewith and said rear legs having a pair of rear wheels respectively associated therewith, c) a seat pivotally connected to said frame and movable between a first position during which the apparatus is used as a wheelchair to a second position during which the apparatus is used as a walker, and d) a converting mechanism associated with one of said pair of wheels, wherein said one of said pair of wheels is movable with the use of said converting mechanism between a first position, where said wheels engage the ground in which the apparatus is used as a wheelchair, to a second position where said wheels are disengaged from the ground in which the apparatus is used as a walker;

e) wherein said converting mechanism further comprises a pair of handle members for respectively moving said each of said pair of wheels about their respective legs between said first and second positions.

29. An apparatus convertible between a walker and a wheelchair for use on the ground comprising:

a) a frame having a first side, a second side and a backrest extending therebetween, each side having a front leg and a rear leg, b) said front legs having a pair of front wheels respectively associated therewith and said rear legs having a pair of rear wheels respectively associated therewith, c) a seat pivotally connected to said frame and movable between a first position during which the apparatus is used as a wheelchair to a second position during which the apparatus is used as a walker, and d) a converting mechanism associated with one of said pair of wheels, wherein said one of said pair of wheels is movable with the use of said converting mechanism between a first position, where said wheels engage the ground in which the apparatus is used as a wheelchair, to a second position where said wheels are disengaged from the ground in which the apparatus is used as a walker, e) wherein said converting mechanism further comprises a pair of handle members for respectively rotating said each of said pair of movable wheels about their respective legs between said first and second positions.

* * * * *